US010730061B2

(12) United States Patent
Peterson et al.

(10) Patent No.: US 10,730,061 B2
(45) Date of Patent: Aug. 4, 2020

(54) AUTOMATICALLY LOCKING SHOWER ARM JOINT

(71) Applicant: WATER PIK, INC., Fort Collins, CO (US)

(72) Inventors: Preston Peterson, Loveland, CO (US); Ryan A. Saunders, Bellvue, CO (US); Kenneth A. Hair, Fort Collins, CO (US)

(73) Assignee: WATER PIK, INC., Fort Collins, CO (US)

( * ) Notice: Subject to any disclaimer, the term of this patent is extended or adjusted under 35 U.S.C. 154(b) by 1007 days.

(21) Appl. No.: 14/874,031

(22) Filed: Oct. 2, 2015

(65) Prior Publication Data

US 2016/0097476 A1 Apr. 7, 2016

Related U.S. Application Data

(60) Provisional application No. 62/059,647, filed on Oct. 3, 2014.

(51) Int. Cl.

| | |
|---|---|
| ***B05B 1/18*** | (2006.01) |
| ***E03C 1/04*** | (2006.01) |
| ***B05B 15/652*** | (2018.01) |
| *E03C 1/06* | (2006.01) |

(52) U.S. Cl.

CPC ..... *B05B 1/185* (2013.01); *B05B 15/652* (2018.02); *E03C 1/0408* (2013.01); *E03C 1/06* (2013.01)

(58) Field of Classification Search

CPC ..... B05B 1/185; B05B 5/60; E03C 1/0408; E03C 1/06

USPC ..... 285/184

See application file for complete search history.

(56) References Cited

U.S. PATENT DOCUMENTS

| | | | |
|---|---|---|---|
| 203,094 | A | 4/1878 | Wakeman |
| 428,023 | A | 5/1890 | Schoff |
| 445,250 | A | 1/1891 | Lawless |
| 486,986 | A | 11/1892 | Schinke |
| 566,410 | A | 8/1896 | Schinke |
| 570,405 | A | 10/1896 | Jerguson et al. |
| 800,802 | A | 10/1905 | Franquist |

(Continued)

FOREIGN PATENT DOCUMENTS

| | | |
|---|---|---|
| AU | 687527 | 11/1996 |
| CA | 659510 | 3/1963 |

(Continued)

OTHER PUBLICATIONS

"Showermaster 2" advertisement, Showermaster, P.O. Box 5311, Coeur d'Alene, ID 83814, as early as Jan. 1997.

*Primary Examiner* — Anna M Momper
*Assistant Examiner* — Fannie C Kee
(74) *Attorney, Agent, or Firm* — Dorsey & Whitney LLP

(57) ABSTRACT

A coupling for fluid pathways, such as for use in connecting showerheads to a fluid source. The coupling includes a fixed member, a movable member rotatably connected to the fixed member, and a locking assembly connected to the fixed member and received within the movable member. In response to a rotational force exceeding a predetermined threshold the locking assembly permits rotation of the movable member relative to the fixed member and when the rotational force drops below the predetermined threshold, the locking assembly prevents rotation of the movable member to the fixed member.

19 Claims, 11 Drawing Sheets

(56) References Cited

U.S. PATENT DOCUMENTS

| | | | |
|---|---|---|---|
| 832,523 | A | 10/1906 | Andersson |
| 854,094 | A | 5/1907 | Klein |
| 926,929 | A | 7/1909 | Dusseau |
| 1,001,842 | A | 8/1911 | Greenfield |
| 1,003,037 | A | 9/1911 | Crowe |
| 1,018,143 | A | 2/1912 | Vissering |
| 1,193,302 | A | 8/1916 | Seltner |
| 1,207,380 | A | 12/1916 | Duffy |
| 1,217,254 | A | 2/1917 | Winslow |
| 1,218,895 | A | 3/1917 | Porter |
| 1,255,577 | A | 2/1918 | Berry |
| 1,260,181 | A | 3/1918 | Garnero |
| 1,276,117 | A | 8/1918 | Riebe |
| 1,284,099 | A | 11/1918 | Harris |
| 1,327,428 | A | 1/1920 | Gregory |
| 1,451,800 | A | 4/1923 | Agner |
| 1,469,528 | A | 10/1923 | Owens |
| 1,500,921 | A | 7/1924 | Bramson et al. |
| 1,560,789 | A | 11/1925 | Johnson et al. |
| 1,597,477 | A | 8/1926 | Panhorst |
| 1,692,394 | A | 11/1928 | Sundh |
| 1,695,263 | A | 12/1928 | Jacques |
| 1,724,147 | A | 8/1929 | Russell |
| 1,736,160 | A | 11/1929 | Jonsson |
| 1,754,127 | A | 4/1930 | Srulowitz |
| 1,758,115 | A | 5/1930 | Kelly |
| 1,778,658 | A | 10/1930 | Baker |
| 1,821,274 | A | 9/1931 | Plummer |
| 1,906,575 | A | 5/1933 | Goeriz |
| 2,011,446 | A | 8/1935 | Judell |
| 2,024,930 | A | 8/1935 | Judell |
| 2,044,445 | A | 6/1936 | Price et al. |
| 2,117,152 | A | 5/1938 | Crosti |
| 2,177,152 | A | 5/1939 | Crosti |
| 2,196,783 | A | 4/1940 | Shook |
| 2,197,667 | A | 4/1940 | Shook |
| 2,268,263 | A | 5/1941 | Newell et al. |
| 2,342,757 | A | 2/1944 | Roser |
| D147,258 | S | 8/1947 | Becker |
| D152,584 | S | 2/1949 | Becker |
| 2,467,954 | A | 4/1949 | Becker |
| 2,472,030 | A | 5/1949 | Thulin |
| 2,546,348 | A | 3/1951 | Schuman |
| 2,581,129 | A | 1/1952 | Muldoon |
| D166,073 | S | 3/1952 | Dunkelberger |
| 2,648,762 | A | 8/1953 | Dunkelberger |
| 2,664,271 | A | 12/1953 | Arutunoff |
| 2,676,806 | A | 4/1954 | Bachman |
| 2,679,575 | A | 5/1954 | Haberstump |
| 2,680,358 | A | 6/1954 | Zublin |
| 2,721,089 | A | 10/1955 | Shames |
| 2,759,765 | A | 8/1956 | Pawley |
| 2,776,168 | A | 1/1957 | Schweda |
| 2,825,135 | A | 3/1958 | Tilden |
| 2,873,999 | A | 2/1959 | Webb |
| 2,931,672 | A | 4/1960 | Merritt et al. |
| 2,966,311 | A | 12/1960 | Davis |
| D190,295 | S | 5/1961 | Becker |
| D192,935 | S | 5/1962 | Becker |
| 3,032,357 | A | 5/1962 | Shames et al. |
| 3,034,809 | A | 5/1962 | Greenberg |
| 3,064,998 | A | 11/1962 | Syverson |
| 3,095,892 | A | 7/1963 | Laing et al. |
| 3,103,723 | A | 9/1963 | Becker |
| 3,111,277 | A | 11/1963 | Grimsley |
| 3,121,235 | A | 2/1964 | Gellmann |
| 3,143,857 | A | 8/1964 | Eaton |
| 3,196,463 | A | 7/1965 | Farneth |
| 3,231,200 | A | 1/1966 | Heald |
| 3,266,059 | A | 8/1966 | Stelle |
| 3,306,634 | A | 2/1967 | Groves et al. |
| 3,329,967 | A | 7/1967 | Martinez et al. |
| 3,389,925 | A | 6/1968 | Gottschald |
| 3,393,311 | A | 7/1968 | Dahl |
| 3,393,312 | A | 7/1968 | Dahl |
| 3,402,893 | A | 9/1968 | Hindman |
| 3,492,029 | A | 1/1970 | French et al. |
| 3,546,961 | A | 12/1970 | Marton |
| 3,556,141 | A | 1/1971 | Hind |
| 3,565,116 | A | 2/1971 | Gabin |
| 3,584,822 | A | 6/1971 | Oram |
| 3,612,577 | A | 10/1971 | Pope |
| 3,641,333 | A | 2/1972 | Gendron |
| 3,663,044 | A | 5/1972 | Contreras et al. |
| 3,669,362 | A | 6/1972 | Meyerhofer et al. |
| 3,669,470 | A | 6/1972 | Deurloo |
| 3,685,745 | A | 8/1972 | Peschcke-Koedt |
| 3,731,084 | A | 5/1973 | Trevorrow |
| 3,754,779 | A | 8/1973 | Peress |
| 3,778,610 | A | 12/1973 | Wolf |
| 3,860,271 | A | 1/1975 | Rodgers |
| 3,861,719 | A | 1/1975 | Hand |
| 3,869,151 | A | 3/1975 | Fletcher et al. |
| 3,910,277 | A | 10/1975 | Zimmer |
| D237,708 | S | 11/1975 | Grohe |
| 3,929,164 | A | 12/1975 | Richter |
| 3,931,992 | A | 1/1976 | Coel |
| D240,178 | S | 6/1976 | Johansen |
| D240,322 | S | 6/1976 | Staub |
| 3,971,074 | A | 7/1976 | Yxfeldt |
| 4,005,880 | A | 2/1977 | Anderson et al. |
| 4,006,920 | A | 2/1977 | Sadler et al. |
| 4,023,782 | A | 5/1977 | Eifer |
| 4,045,054 | A | 8/1977 | Arnold |
| D249,356 | S | 9/1978 | Nagy |
| 4,162,801 | A | 7/1979 | Kresky et al. |
| 4,174,822 | A | 11/1979 | Larsson |
| 4,243,253 | A | 1/1981 | Rogers, Jr. |
| 4,258,414 | A | 3/1981 | Sokol |
| D259,054 | S | 4/1981 | Petersons |
| 4,274,400 | A | 6/1981 | Baus |
| 4,282,612 | A | 8/1981 | King |
| D262,353 | S | 12/1981 | Kitson |
| 4,358,056 | A | 11/1982 | Greenhut et al. |
| D268,442 | S | 3/1983 | Darmon |
| D268,609 | S | 4/1983 | Thompson |
| 4,383,554 | A | 5/1983 | Merriman |
| 4,396,797 | A | 8/1983 | Sakuragi et al. |
| 4,425,965 | A | 1/1984 | Bayh, III et al. |
| 4,465,308 | A | 8/1984 | Martini |
| 4,479,610 | A | 10/1984 | Etheridge et al. |
| 4,495,550 | A | 1/1985 | Visciano |
| 4,540,202 | A | 9/1985 | Amphoux et al. |
| 4,545,081 | A | 10/1985 | Nestor et al. |
| 4,545,535 | A | 10/1985 | Knapp |
| 4,553,775 | A | 11/1985 | Halling |
| D281,820 | S | 12/1985 | Oba et al. |
| 4,568,216 | A | 2/1986 | Mizusawa et al. |
| 4,571,003 | A | 2/1986 | Roling et al. |
| D283,645 | S | 4/1986 | Tanaka |
| 4,643,463 | A | 2/1987 | Halling et al. |
| 4,645,244 | A | 2/1987 | Curtis |
| 4,651,770 | A | 3/1987 | Denham et al. |
| 4,652,025 | A | 3/1987 | Conroy, Sr. |
| 4,669,757 | A | 6/1987 | Bartholomew |
| 4,683,917 | A | 8/1987 | Bartholomew |
| 4,707,770 | A | 11/1987 | Van Duyn |
| 4,717,180 | A | 1/1988 | Roman |
| 4,722,029 | A | 1/1988 | Ahle et al. |
| 4,733,337 | A | 3/1988 | Bieberstein |
| 4,739,801 | A | 4/1988 | Kimura et al. |
| 4,752,975 | A | 6/1988 | Tiernan |
| 4,790,294 | A | 12/1988 | Allred, III et al. |
| 4,809,369 | A | 3/1989 | Bowden |
| 4,839,599 | A | 6/1989 | Fischer |
| 4,842,059 | A | 6/1989 | Tomek |
| D302,325 | S | 7/1989 | Charet et al. |
| 4,850,616 | A | 7/1989 | Pava |
| 4,856,822 | A | 8/1989 | Parker |
| 4,863,328 | A | 9/1989 | Malek |
| 4,865,362 | A | 9/1989 | Holden |
| 4,871,196 | A | 10/1989 | Kingsford |
| D306,351 | S | 2/1990 | Charet et al. |
| 4,901,765 | A | 2/1990 | Poe |

(56) References Cited

U.S. PATENT DOCUMENTS 4,901,927 A 2/1990 Valdivia
4,903,178 A 2/1990 Englot et al.
4,907,137 A 3/1990 Schladitz et al.
4,946,202 A 8/1990 Perricone
4,951,329 A 8/1990 Shaw
4,959,758 A 9/1990 Filosa et al.
4,964,573 A 10/1990 Lipski
4,972,048 A 11/1990 Martin
4,975,123 A 12/1990 Gray
D314,246 S 1/1991 Bache
5,004,158 A 4/1991 Halem et al.
5,022,103 A 6/1991 Faist
5,032,015 A 7/1991 Christianson
5,033,528 A 7/1991 Volcani
5,046,764 A 9/1991 Kimura et al.
D321,062 S 10/1991 Bonbright
D322,681 S 12/1991 Yuen
5,071,070 A 12/1991 Hardy
5,086,878 A 2/1992 Swift
D325,769 S 4/1992 Haug et al.
5,103,384 A 4/1992 Drohan
5,107,406 A 4/1992 Sekido et al.
5,134,251 A 7/1992 Martin
5,135,173 A 8/1992 Cho
D329,504 S 9/1992 Yuen
5,143,123 A 9/1992 Richards et al.
5,148,556 A 9/1992 Bottoms, Jr. et al.
5,153,976 A 10/1992 Benchaar et al.
5,154,483 A 10/1992 Zeller
5,163,752 A 11/1992 Copeland et al.
5,197,767 A 3/1993 Kimura et al.
5,215,338 A 6/1993 Kimura et al.
5,220,697 A 6/1993 Birchfield
D337,839 S 7/1993 Zeller
D338,542 S 8/1993 Yuen
5,254,809 A 10/1993 Martin
D341,220 S 11/1993 Eagan
5,263,646 A 11/1993 McCauley
5,265,833 A 11/1993 Heimann et al.
5,268,826 A 12/1993 Greene
5,276,596 A 1/1994 Krenzel
5,286,071 A 2/1994 Storage
5,288,110 A 2/1994 Allread
D345,811 S 4/1994 Van Deursen et al.
5,333,787 A 8/1994 Smith et al.
5,333,789 A 8/1994 Garneys
5,340,165 A 8/1994 Sheppard
5,349,987 A 9/1994 Shieh
5,356,036 A 10/1994 Garnett
5,356,076 A 10/1994 Bishop
5,368,235 A 11/1994 Drozdoff et al.
5,369,556 A 11/1994 Zeller
5,370,427 A 12/1994 Hoelle et al.
5,385,500 A 1/1995 Schmidt
D356,626 S 3/1995 Wang
5,398,977 A 3/1995 Berger et al.
D361,399 S 8/1995 Carbone et al.
5,449,206 A 9/1995 Lockwood
D363,360 S 10/1995 Santarsiero
5,468,057 A 11/1995 Megerle et al.
D364,935 S 12/1995 deBlois
D365,625 S 12/1995 Bova
D365,646 S 12/1995 deBlois
D366,707 S 1/1996 Kaiser
D366,708 S 1/1996 Santarsiero
D366,709 S 1/1996 Szymanski
D366,710 S 1/1996 Szymanski
5,481,765 A 1/1996 Wang
D366,948 S 2/1996 Carbone
D367,333 S 2/1996 Swyst
D367,934 S 3/1996 Carbone
D368,146 S 3/1996 Carbone
D368,317 S 3/1996 Swyst
D368,539 S 4/1996 Carbone et al.
D368,540 S 4/1996 Santarsiero
D368,541 S 4/1996 Kaiser et al.
D368,542 S 4/1996 deBlois et al.
D369,873 S 5/1996 deBlois et al.
D369,874 S 5/1996 Santarsiero
D369,875 S 5/1996 Carbone
D370,277 S 5/1996 Kaiser
D370,278 S 5/1996 Nolan
D370,279 S 5/1996 deBlois
D370,280 S 5/1996 Kaiser
D370,281 S 5/1996 Johnstone et al.
5,517,392 A 5/1996 Rousso et al.
5,521,803 A 5/1996 Eckert et al.
D370,542 S 6/1996 Santarsiero
D370,735 S 6/1996 DeBlois
D370,987 S 6/1996 Santarsiero
D370,988 S 6/1996 Santarsiero
D371,448 S 7/1996 Santarsiero
D371,618 S 7/1996 Nolan
D371,619 S 7/1996 Szymanski
D371,856 S 7/1996 Carbone
D372,318 S 7/1996 Szymanski
D372,319 S 7/1996 Carbone
5,531,625 A 7/1996 Zhong
D372,548 S 8/1996 Carbone
D372,998 S 8/1996 Carbone
D373,210 S 8/1996 Santarsiero
D373,434 S 9/1996 Nolan
D373,435 S 9/1996 Nolan
D373,645 S 9/1996 Johnstone et al.
D373,646 S 9/1996 Szymanski et al.
D373,647 S 9/1996 Kaiser
D373,648 S 9/1996 Kaiser
D373,649 S 9/1996 Carbone
D373,651 S 9/1996 Szymanski
D373,652 S 9/1996 Kaiser
D374,297 S 10/1996 Kaiser
D374,298 S 10/1996 Swyst
D374,299 S 10/1996 Carbone
D374,493 S 10/1996 Szymanski
D374,494 S 10/1996 Santarsiero
D374,732 S 10/1996 Kaiser
D374,733 S 10/1996 Santarsiero
5,567,115 A 10/1996 Carbone
D376,217 S 12/1996 Kaiser
D376,860 S 12/1996 Santarsiero
D376,861 S 12/1996 Johnstone et al.
D376,862 S 12/1996 Carbone
5,624,074 A 4/1997 Parisi
D379,404 S 5/1997 Spelts
D381,405 S 7/1997 Waidele et al.
5,660,079 A 8/1997 Friedrich
5,667,146 A 9/1997 Pimentel et al.
5,692,252 A 12/1997 Zwezdaryk
5,749,602 A 5/1998 Delaney et al.
5,778,939 A 7/1998 Hok-Yin
D398,370 S 9/1998 Purdy
D401,680 S 11/1998 Tiernan
5,865,378 A 2/1999 Hollinshead et al.
D406,636 S 3/1999 Male et al.
D413,157 S 8/1999 Ratzlaff
5,997,047 A 12/1999 Pimentel et al.
6,042,155 A 3/2000 Lockwood
6,095,801 A 8/2000 Spiewak
D431,072 S 9/2000 Milrud et al.
6,164,569 A 12/2000 Hollinshead et al.
6,164,570 A 12/2000 Smeltzer
6,199,729 B1 3/2001 Drzymkowski
D440,641 S 4/2001 Hollinshead et al.
6,227,456 B1 5/2001 Colman
6,276,004 B1 8/2001 Bertrand et al.
6,336,764 B1 1/2002 Liu
6,382,531 B1 5/2002 Tracy
6,425,149 B1 7/2002 Wang
6,450,425 B1 9/2002 Chen
6,464,265 B1 10/2002 Mikol
D465,553 S 11/2002 Singtoroj
6,511,001 B1 1/2003 Huang
D470,219 S 2/2003 Schweitzer
6,537,455 B2 3/2003 Farley

(56) References Cited

U.S. PATENT DOCUMENTS

| | | | | |
|---|---|---|---|---|
| 6,626,210 | B2 | 9/2003 | Luettgen et al. | |
| 6,629,651 | B1 | 10/2003 | Male et al. | |
| 6,643,862 | B2 | 11/2003 | Aitken | |
| 6,659,117 | B2 | 12/2003 | Gilmore | |
| 6,701,953 | B2 | 3/2004 | Agosta | |
| D496,446 | S | 9/2004 | Zwezdaryk | |
| 6,840,353 | B2 * | 1/2005 | Arisaka | F16F 9/12 188/130 |
| D502,761 | S | 3/2005 | Zieger et al. | |
| 6,863,227 | B2 | 3/2005 | Wollenberg et al. | |
| 6,926,212 | B1 | 8/2005 | Glass | |
| D517,669 | S | 3/2006 | Zieger et al. | |
| D520,105 | S | 5/2006 | Kosasih | |
| 7,066,411 | B2 | 6/2006 | Male et al. | |
| 7,097,122 | B1 | 8/2006 | Farley | |
| D529,151 | S | 9/2006 | Macan | |
| D531,259 | S | 10/2006 | Hseih | |
| 7,147,172 | B2 | 12/2006 | Darling, III et al. | |
| 7,201,331 | B2 | 4/2007 | Bertrand | |
| 7,299,510 | B2 | 11/2007 | Tsai | |
| D557,770 | S | 12/2007 | Hoernig | |
| D559,953 | S | 1/2008 | Bickler et al. | |
| 7,533,906 | B2 | 5/2009 | Luettgen et al. | |
| D618,766 | S | 6/2010 | Whitaker et al. | |
| D627,866 | S | 11/2010 | Hanna | |
| 7,905,429 | B2 | 3/2011 | Somerfield et al. | |
| 8,024,822 | B2 | 9/2011 | Macan et al. | |
| D647,603 | S | 10/2011 | Andrew | |
| 8,070,076 | B2 | 12/2011 | Erickson et al. | |
| D668,320 | S | 10/2012 | Weihreter | |
| 2002/0033424 | A1 | 3/2002 | Rivera et al. | |
| 2002/0070292 | A1 | 6/2002 | Hazenfield | |
| 2004/0163169 | A1 | 8/2004 | Kollmann et al. | |
| 2005/0283904 | A1 | 12/2005 | Macan et al. | |
| 2006/0151632 | A1 | 7/2006 | Larsen | |
| 2006/0208111 | A1 | 9/2006 | Tracy et al. | |
| 2006/0231648 | A1 | 10/2006 | Male et al. | |
| 2007/0251590 | A1 | 11/2007 | Weinstein | |
| 2007/0272312 | A1 | 11/2007 | Chang | |
| 2008/0083844 | A1 | 4/2008 | Leber et al. | |
| 2008/0121293 | A1 | 5/2008 | Leber et al. | |
| 2008/0271240 | A1 | 11/2008 | Leber et al. | |
| 2010/0065657 | A1 * | 3/2010 | Lee | B05B 1/185 239/224 |
| 2011/0139900 | A1 | 6/2011 | Somerfield et al. | |
| 2014/0360614 | A1 | 12/2014 | Leber et al. | |

FOREIGN PATENT DOCUMENTS

| | | |
|---|---|---|
| CA | 2150317 | 11/1995 |
| CA | 2538810 | 9/2006 |
| DE | 352813 | 5/1922 |
| DE | 854100 | 10/1952 |
| DE | 2360534 | 6/1974 |
| DE | 2806093 | 8/1979 |
| DE | 3246327 | 12/1982 |
| DE | 4034695 | 5/1991 |
| DE | 4142198 | 4/1993 |
| DE | 19608085 | 3/1998 |
| EP | 0167063 | 6/1985 |
| EP | 0683354 | 11/1995 |
| EP | 0687851 | 12/1995 |
| EP | 0695907 | 2/1996 |
| EP | 0721082 | 7/1996 |
| FR | 538538 | 6/1922 |
| FR | 1098836 | 8/1955 |
| FR | 2596492 | 10/1987 |
| FR | 2695452 | 3/1994 |
| GB | 10086 | 5/1893 |
| GB | 3314 | 12/1914 |
| GB | 129812 | 7/1919 |
| GB | 204600 | 10/1923 |
| GB | 634483 | 3/1950 |
| GB | 971866 | 10/1964 |
| GB | 2156932 | 10/1985 |
| GB | 2298595 | 9/1996 |
| IT | 327400 | 7/1936 |
| IT | 350359 | 7/1937 |
| JP | S63-181459 | 11/1988 |
| JP | H2-78660 | 6/1990 |
| NL | 8902957 | 6/1991 |
| WO | WO93/12894 | 7/1993 |
| WO | WO93/25839 | 12/1993 |
| WO | WO96/23999 | 8/1996 |
| WO | WO98/30336 | 7/1998 |

* cited by examiner

AUTOMATICALLY LOCKING SHOWER ARM JOINT

CROSS REFERENCE TO RELATED APPLICATIONS

This application claims priority to U.S. provisional application No. 62/059,647 filed 3 Oct. 2014 and entitled "Automatically Locking Shower Arm Joint," the disclosure of which is hereby incorporated by reference herein in its entirety.

TECHNICAL FIELD

The technology disclosed herein relates generally to showerheads, and more specifically to supporting structures, such as showerhead arms, for supporting fixed and handheld showerheads.

BACKGROUND

Many showerheads attach directly to a water supply pipe (e.g., J-pipe) provided within a shower or enclosure. Typically, showerheads may pivot about or near the connection of the head and the water supply pipe. Such pivoting allows the user to direct the water emitted from the head to a desirable or useful location. Other showerheads may be attached to a shower arm that extends from the water supply pipe. Shower arms allow the user to position a showerhead away from the support structure of the water supply pipe and/or otherwise position the showerhead as desired. However, connections directly to the water supply pipe and showerhead or a shower arm are often rather stiff, making pivoting of the showerhead difficult and require the user to manually activate a device, such as a wingnut, button, lever, or the like, to reposition the showerhead. The manual activation of a separate element may be difficult for a user especially in a wet environment, such as the shower area. Accordingly, there is a need for an improved shower arm that includes an automatically locking joint.

The information included in this Background section of the specification, including any references cited herein and any description or discussion thereof, is included for technical reference purposes only and is not to be regarded subject matter by which the scope of the invention is to be bound.

SUMMARY

One of embodiment of the present disclosure includes a coupling for fluid pathways, such as for use in connecting showerheads to a fluid source. The coupling includes a fixed member, a movable member rotatably connected to the fixed member, and a locking assembly connected to the fixed member and received within the movable member. In response to a rotational force exceeding a predetermined threshold the locking assembly permits rotation of the movable member relative to the fixed member and when the rotational force drops below the predetermined threshold, the locking assembly prevents rotation of the movable member to the fixed member.

Another embodiment of the present disclosure includes an automatically locking joint for a shower arm. The locking joint includes a first body and a second body defining a locking cavity and movably connected to the first body. The locking joint further includes a locking assembly at least partially received within the locking cavity of the second body. The locking assembly includes a clutch slider connected to the second body and configured to rotate therewith and a clutch cap positioned adjacent to the clutch slider and fixedly connected to the first body. In this embodiment, rotation of the second body relative to the first body causes the clutch slider to selectively engage and disengage from the clutch cap.

Yet another embodiment of the present disclosure includes an automatically locking coupling. The coupling includes a first member, a second member, and a locking assembly. The locking assembly is connected to the second member and selectively permits rotation of the second member relative to the first member. The locking assembly includes a sliding member coupled to the second member and rotatable therewith and movable longitudinally relative to the first member and a cap anchored to the first member. The sliding member engages with the cap to retain the first member and the second member in fixed position relative to one another. Upon application of a rotational force to the second member, the sliding member is disengages from the cap and allows rotation of the second member relative to the first member.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. A more extensive presentation of features, details, utilities, and advantages of the present invention as defined in the claims is provided in the following written description of various embodiments of the invention and illustrated in the accompanying drawings.

DETAILED DESCRIPTION

Figure 1A:
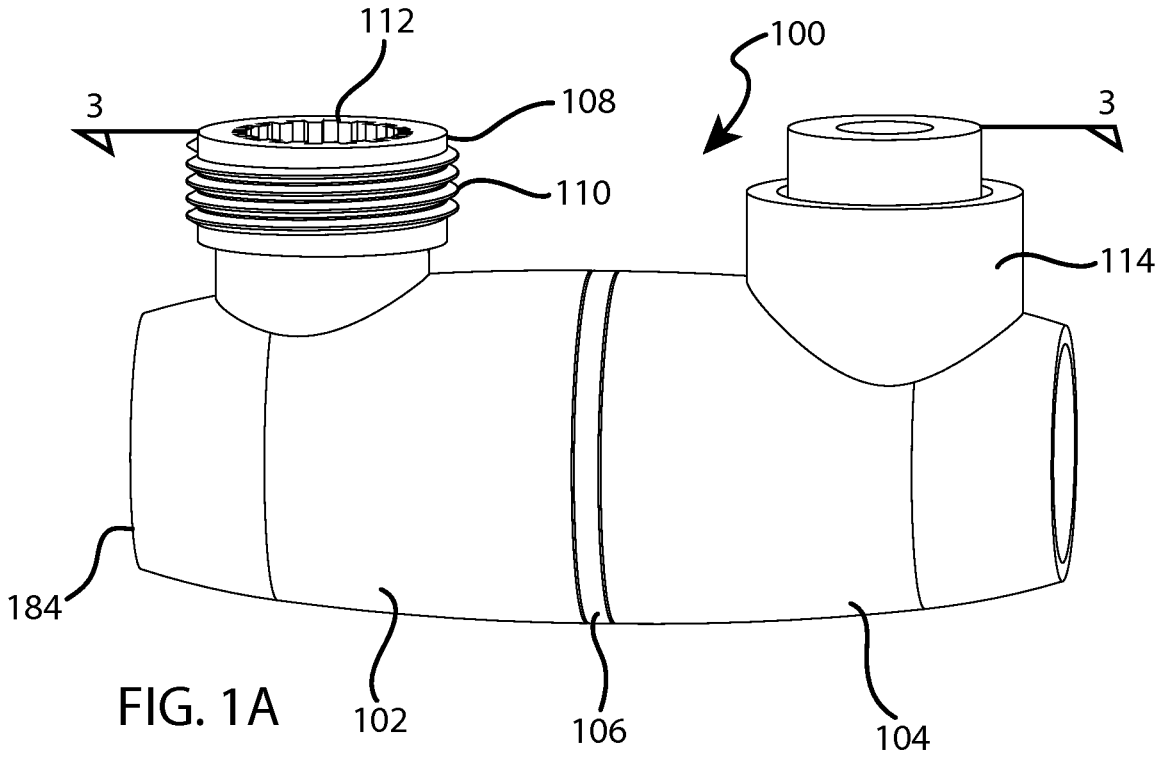
FIG. 1A is a front isometric view of a joint assembly for supporting one or more showerheads, shower arms, brackets, and/or handheld showerheads.

This disclosure is related to an automatically locking arm joint for a showerhead arm. The locking arm joint may be used with a variety of different types of shower arms for supporting substantially any type of showerhead, including fixed or wall mounted showerheads and handheld showerheads. The locking arm joint allows a user to pivot one showerhead or showerhead arm relative to a water supply pipe, another shower arm, and/or another showerhead. The locking arm joint does not require a release mechanism, such as a button, lever, or wingnut, and thus the user can manipulate the position of the shower arm without manually activating a separate release element. This allows a user to reposition the showerhead or arm with one hand in a single motion, which is not possible with conventional coupling members.

In one embodiment, the automatically locking arm joint may include a locking assembly connected to a first joint body. The locking arm joint includes a clutch slider, a clutch cap, and a biasing element. The clutch slider includes a plurality of engagement features on its outer end and is keyed to the first joint body so that the clutch slider will rotate with the first joint body. The clutch slider is also able to move longitudinally with the joint body along a portion of a length of the first joint body. The clutch cap is fixedly connected to a second joint body, which is rotatably connected to the first joint body. As the first joint body rotates relative to the clutch cap and second joint body, the clutch cap remains stationary. The clutch cap includes a plurality of engagement features on its interior end configured to selectively mesh with the engagement features on the clutch slider. The biasing element is seated within the first joint body and biases against the bottom end of the clutch slider to force the engagement features of the clutch slider towards the interior end of the clutch cap.

In a locked position, the engagement features of the clutch cap are aligned relative to the engagement features of the clutch slider so as to mesh together. The meshing of the engagement features causes the arm joint to lock. To move the arm, the user rotates one of the first joint body or the second joint body causing one of the clutch slider or the clutch cap to rotate relative to the other. The engagement features of the clutch slider move out of meshed engagement with the engagement features of the clutch cap, which allows the first or second joint body to rotate relative to the other. In one specific example, the engagement features may be formed as facial or crown gears and, during the rotation, the gears slip relative to one another.

As the arm joint rotates, the biasing force exerted by the biasing spring is overcome allowing the disengagement of the engagement features. However, when the rotational force is removed, the biasing spring exerts a biasing force against the clutch slider to move it laterally towards the clutch cap. Thus, as soon as the first or second joint body moves a predetermined amount, the biasing element causes the engagement features of the clutch slider to move back into a meshed engagement with the engagement features of the clutch cap, albeit at a different angular alignment, to again lock the arm joint. In this embodiment, the locking joint can be automatically locked and unlocked by rotating the first joint body and/or the second joint body.

In some embodiments, the locking joint assembly may also include a dampening element that exerts a frictional force to increase the drag between the first joint body and the second joint body to slow rotation of the first joint body. This feature helps to prevent a user from inadvertently rotating the first joint body farther than desired. The dampening element may also be configured to provide a desired haptic feel and/or response to the user, i.e., feedback, to the user, regarding the position of the first joint body. For example, the dampening element may be configured to provide a smooth and controlled feeling to the user during movement.

Figure 1B:
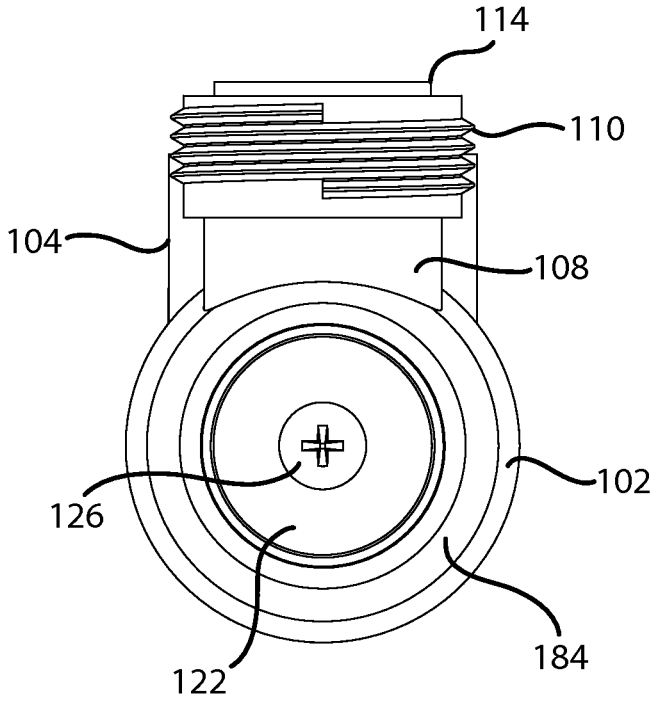
FIG. 1B is a left side elevation view of the joint assembly of FIG. 1A.
Figure 2:
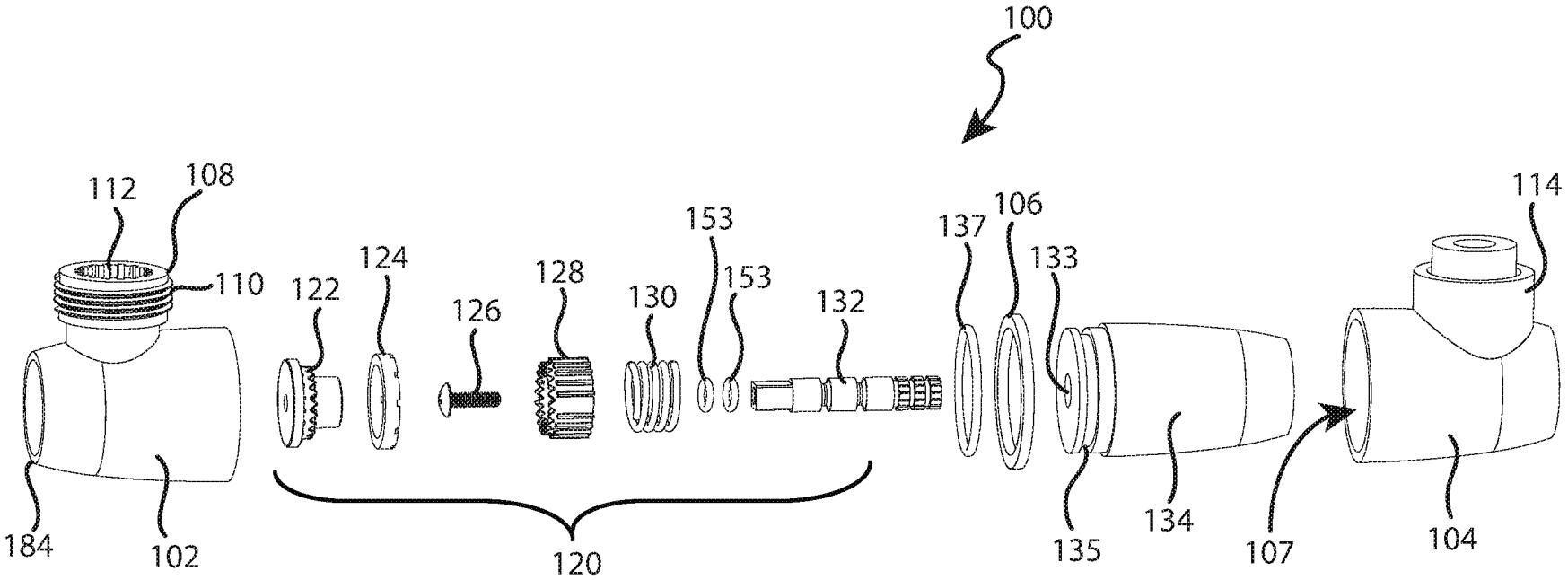
FIG. 2 is an exploded view of the joint assembly of FIG. 1A.
Figure 3:
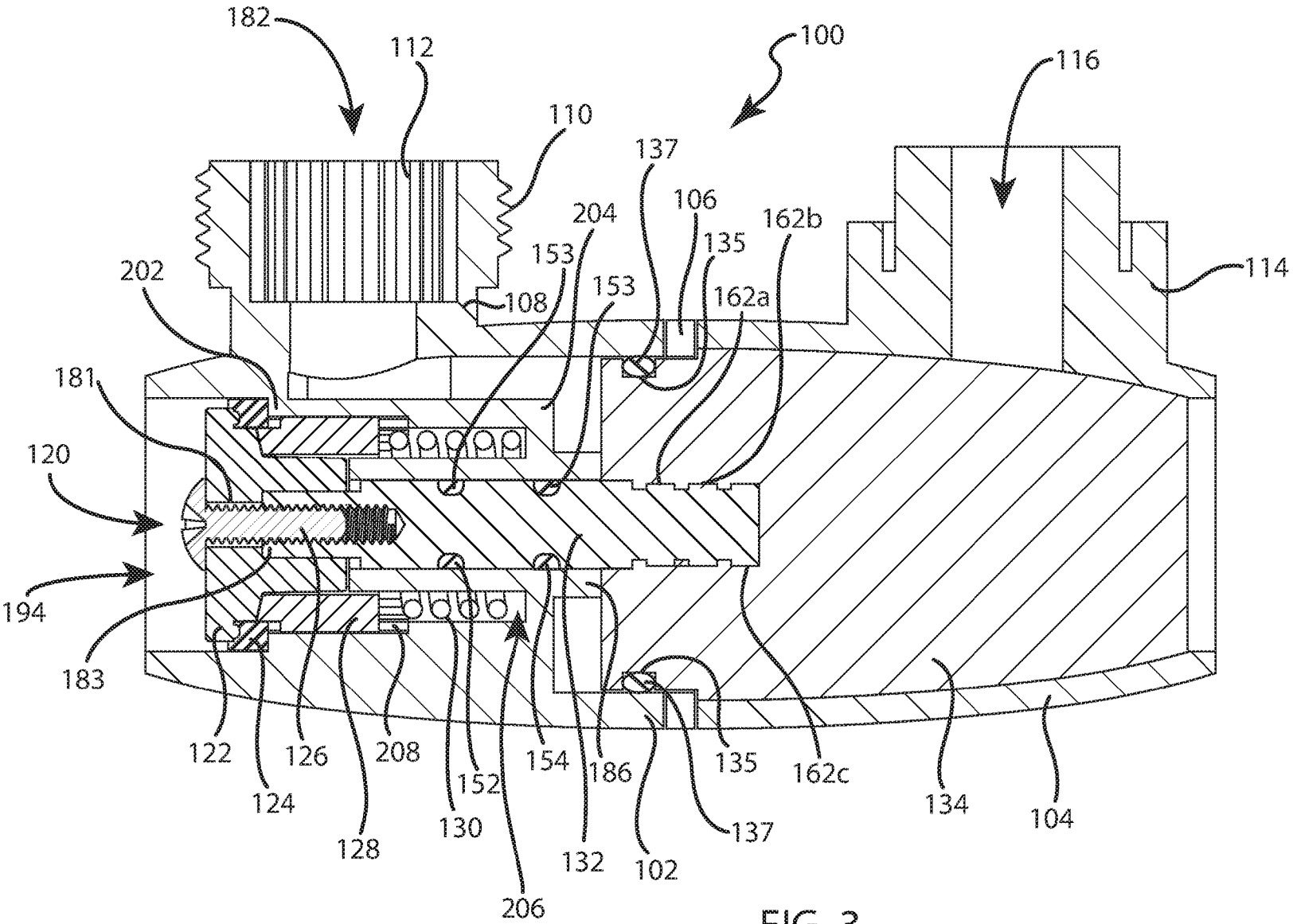
FIG. 3 is a cross-section view of the joint assembly of FIG. 1A taken along line 3-3 in FIG. 1A.

Turning to the figures, a coupling of the present disclosure will be discussed in more detail. FIG. 1A is front elevation view of a joint assembly 100. FIG. 1B is a left side elevation view of the joint assembly 100. FIG. 2 is an exploded view of the joint assembly 100. FIG. 3 is a cross-section view of the joint assembly 100 taken along line 3-3 in FIG. 1. With reference to FIGS. 1A-3, the joint assembly 100 may include a first joint body 102, a second joint body 104, and a locking assembly 120 received within the first joint body 102. Each will be discussed in more detail below.

The first and second joint bodies 102, 104 may be somewhat similar and each may include one or more passageways for fluidly connecting a showerhead or other shower accessory (e.g., hose or tube) to one or more components. The terms first and second are arbitrary and used to distinguish the two bodies relative to each other. These terms may be used interchangeably depending on which body rotates to the other.

The second joint body 104 forms a fixed member of the coupling and may be a generally elliptically shaped hollow tube and may include a fixed connector 114 extending generally normal from a sidewall thereof. The fixed connector 114 is configured to connect to a J-pipe, showerhead, bracket, or the like, and may include a desired connection mechanism, such as threading, press-fit features, or the like, that allows the fixed connector 114 to be connected to the desired component. The location, position, orientation, and connection features of the fixed connector 114 may be varied as desired, based on the type of showerhead, water supply pipe, and/or other factors.

The first joint body 102 defines a movable member and may be somewhat similar to the second joint body 104 and may be generally an elliptically shaped, substantially hollow member. The first joint body 102 may include a showerhead connector 108 extending normally from a sidewall of the first joint body 102 with a plurality of securing features 110 (e.g., threads) configured to connect to various components, such as a showerhead, handheld showerhead bracket, or the like. An interior surface of the showerhead connector 108 may also be formed with keying features 112, for example, for assisting in the orientation of an attachment component. However, the first joint body 102 may also include a plurality of internal features that are used to house and activate various components of the locking assembly 120, as will be discussed in more detail below.

Figure 4B:
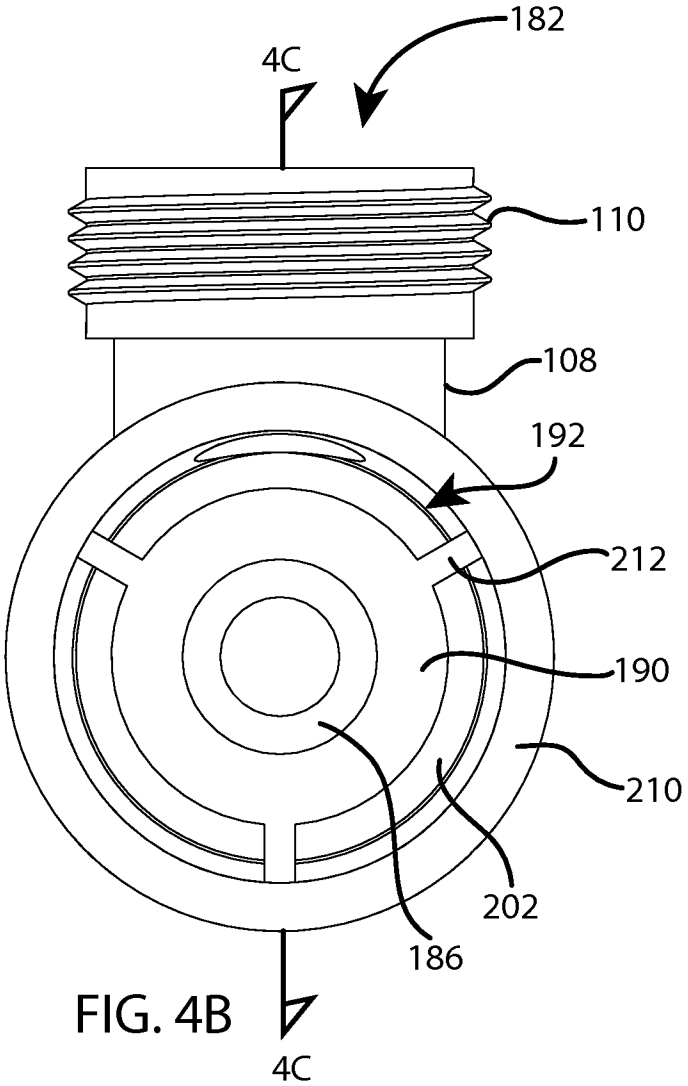
FIG. 4B is a right side elevation view of the first joint body.
Figure 4A:
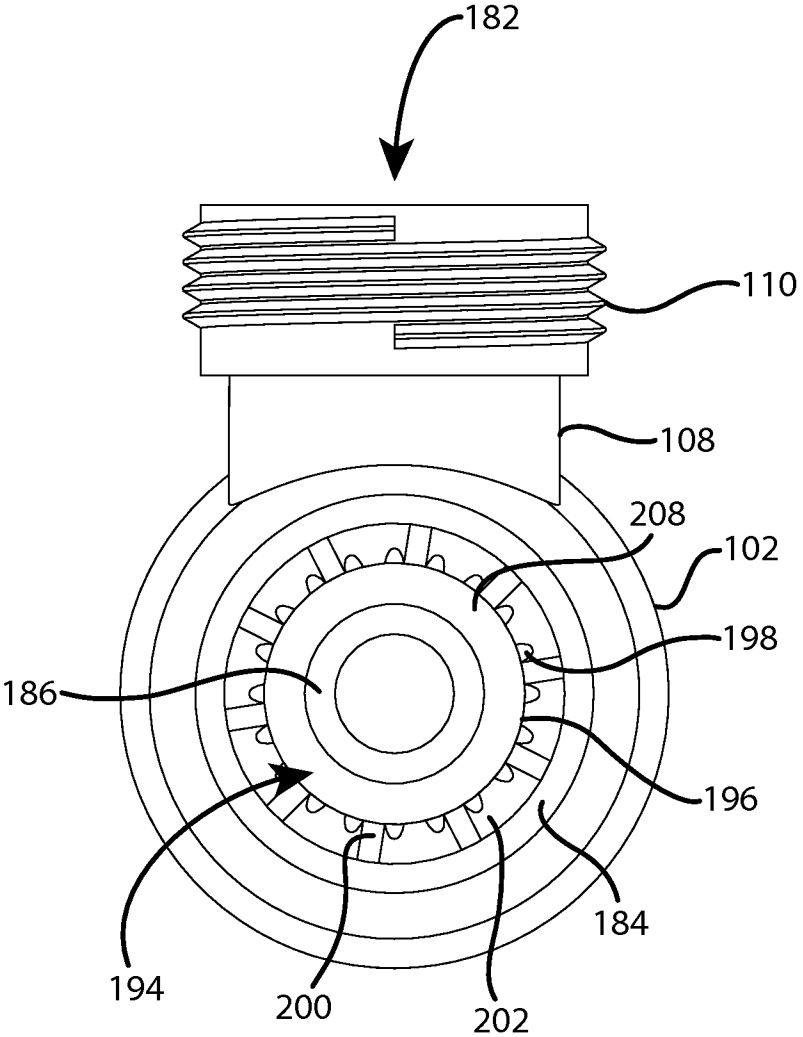
FIG. 4A is a left side elevation view of a first joint body of the joint assembly of FIG. 1A.
Figure 4C:
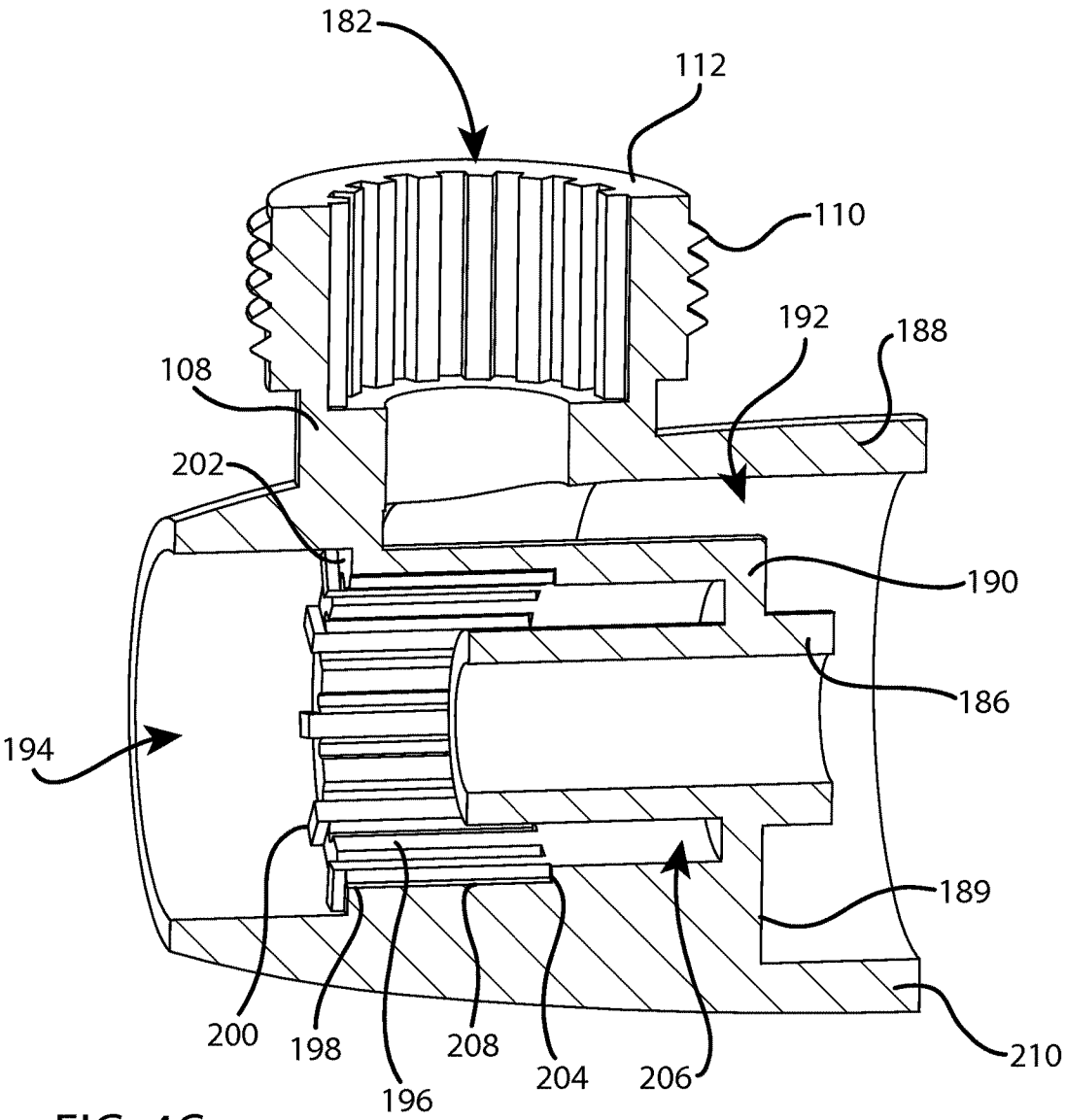
FIG. 4C is a cross-section view of the first joint body taken along line 4C-4C in FIG. 4B.

FIGS. 4A-4C illustrate various views of the first joint body 102. With reference to FIGS. 4A-4C, first joint body 102 includes a first end 184, a second end 210, and an outer wall 188 that defines the outer diameter of the first joint body 102. The first end 184 of the first joint body 102 may define a locking cavity 194 that receives the various components of the locking assembly. The locking cavity 194 is defined by the outer wall 188 and a locking bracket 190 that extends from the outer wall and into a center of the first joint body 102.

The locking bracket 190 defines a generally cylindrically shaped protrusion that extends within the passageway formed by the outer wall 188. In particular, the locking bracket 190 extends inwards from an interior surface of the outer wall 188 and generally longitudinally concentric with and along a length of the first joint body 102. The first joint body 102 may also include a cylindrical shaft duct 186 connected to the locking bracket 190 and may be oriented generally concentrically within the locking bracket 190. The locking bracket 190 and the shaft duct 186 are thus nested within the first joint body 102. The shaft duct 186 extends past a back end wall 189 of the locking bracket 190 and terminates before a top end or seat 202 of the locking bracket 190.

With reference to FIGS. 4A and 4C, the locking bracket 190 may include a stepped interior surface that defines the seat 202 and a stop 204. The seat 202 forms a front of the locking bracket 190 and is stepped radially inward from the outer wall 188 and connected thereto to define a ledge within the first joint body 102. The stop 204 is defined as another ledge that extends radially into the interior of the first joint body 102 from the outer wall of the locking bracket 190 and further reduces the diameter of the locking cavity 194. An annular spring cavity 206 is defined within the locking bracket 190 from the stop 204 to a back end wall 189 of the locking bracket 190 and around the outer surface of the shaft duct 186.

A slide track 208 for the locking assembly 120 is defined on an interior surface of the sidewalls of the locking bracket 190. The slide track 208 may include one or ribs 196 and one or more grooves 198. The ribs 196 and grooves 198 both extend longitudinally along a portion of a length of the first joint body 102. Additionally, the slide track 208 may include one or more engagement ribs 200 that extend longer than the ribs 196 and grooves 198. As shown in FIGS. 4A and 4C, the engagement ribs 200 may extend beyond the seat 202 toward the first end 184 of the first joint body 102 while the ribs 196 and grooves 198 terminate at the seat 202.

With reference to FIG. 4B, in some embodiments, one or more braces 212 may extend radially inward from the interior surface of the outer wall 188 to support the locking bracket 190 within the cavity defined by the outer wall 188.

With reference to FIGS. 4A-4C, a fluid passage 192 may be defined between a top surface of the locking bracket 190 and the interior surface of the outer wall 188. The fluid passage 192 is fluidly connected to a port 182 defined by an opening in the showerhead head connector 108. The size and orientation of the fluid passage 192 may be varied as desired.

With reference again to FIG. 2, the joint assembly 100 may also include a joint core 134 having a shaft aperture 133 defined through a central region thereof. The joint core 134 generally tracks the shape of the second joint body 104 and is received in a cavity 107 defined therein and connected to the second joint body 104. In some embodiments, the joint core 134 may also define a fluid passageway (not shown) that connects with fluid passageway 192 in order to convey water between inlet 116 and port 182. The joint core 134 may also include an annular groove 135 defined around an outer surface and configured to receive a sealing member 137.

The locking assembly 120 for the joint assembly 100 will now be discussed in more detail. With reference to FIGS. 2 and 3, the locking assembly 120 may include a clutch cap 122, a dampener 124, a fastener 126, a clutch slider 128, a biasing element 130, and a pivot shaft 132. Each of the elements will be discussed in detail below.

Figure 5A:
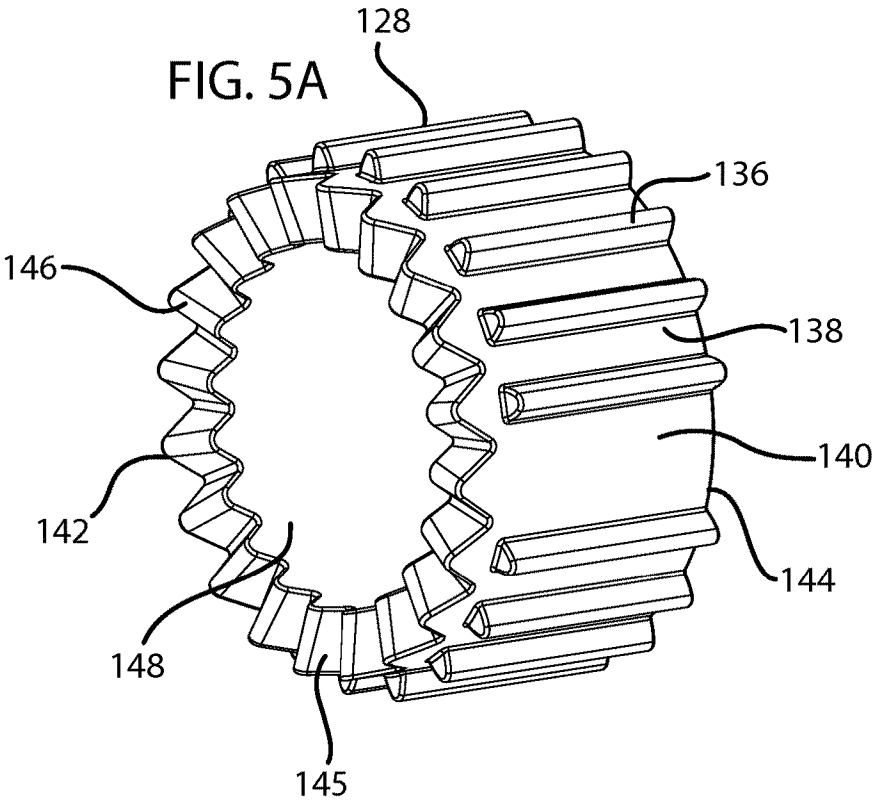
FIG. 5A is a front isometric view of a clutch slider of the joint assembly of FIG. 1A.
Figure 5B:
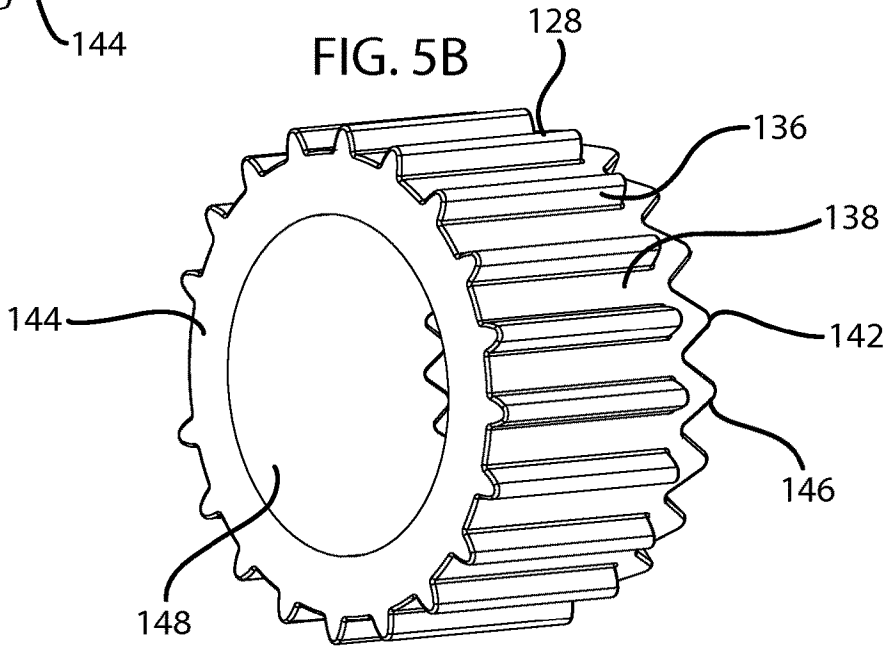
FIG. 5B is a rear isometric view of the clutch slider of FIG. 5A.

FIGS. 5A and 5B illustrate various views of the clutch slider 128. With reference to FIGS. 5A and 5B, the clutch slider 128 is a generally cylindrically-shaped hollow ring including a first end 142 and a second end 144 with an outer surface 138 and an inner surface 148. The outer surface 138 of the clutch slider 128 includes a plurality of ribs 136 that extend longitudinally along a length of the clutch slider 128. The ribs 136 are generally spaced at equal distances from each adjacent rib. However, in some embodiments, the clutch slider 128 may include an alignment feature 140 defined on a portion of the outer surface 138 that interrupts the positioning of the ribs 136. In one embodiment, the alignment feature 140 may be a smooth portion of the outer surface 138 without any ribs 136. Other alignment features 140 may be used as well, such as specifically shaped protrusions, ribs, and/or recesses. The ribs 136 may extend generally to the outer edge of the second end 144, but may typically terminate before reaching the outer edge of the first end 142.

With continued reference to FIGS. 5A and 5B, the clutch slider 128 may include an engagement structure 146 defined on the first end 142 thereof. In one embodiment, the engagement structure 146 may define a plurality of teeth 145 or splines configured to mesh with corresponding teeth or splines on the clutch cap 122. As one example, the engagement structure 146 may be formed like a crown gear on the end surface of the first end 142 of the clutch slider 128. However, it should be noted that many other types of engagement structures are envisioned and the crown gear is merely one example.

Figure 6:
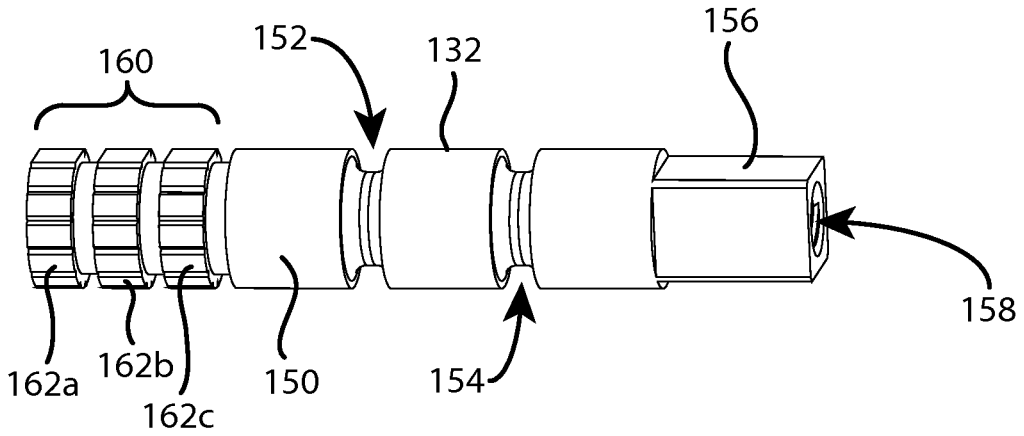
FIG. 6 is an isometric view of a pivot shaft of the joint assembly of FIG. 1A.

FIG. 6 is a side isometric view of pivot shaft 132 for the locking assembly 120. With reference to FIGS. 3 and 6, the pivot shaft 132 may have a body 150 formed as an elongated generally cylindrical shaft that may include one or more keying elements defined thereon. For example, the pivot shaft 132 may include a secured end 160 and a keyed end 156. The secured end 160 may include a plurality of securing features 162*a*, 162*b*, 162*c* that extend annularly around the outer surface of the pivot shaft 132. The securing features 162*a*, 162*b*, 162*c* may be a plurality of flat faces or facets formed around the outer surface and formed as separate bands apart from one another, but other types of securing features may be used as well.

With continued reference to FIGS. 3 and 6, the pivot shaft 132 may also include one or more annular grooves 152, 154. The annular grooves 152, 154 may be configured to receive one or more sealing members 153, such as one or more O-rings or cup seals. As such, the number, width, and positioning of the annular grooves 152, 154 may be varied as desired and based on the type of sealing members that may be used with the locking assembly 120.

The keyed end 156 of the pivot shaft 132 may be shaped to define a keying structure. For example, in one embodiment, the keyed end 156 may include a plurality of flat outer surfaces, whereas the rest of the body 150 of the shaft 132 may be generally circular.

The pivot shaft 132 may also include a fastening aperture 158 defined on a terminal end of the body on the keyed end 156 of the shaft 132. The fastening aperture 158 may extend through the keyed end 156 and into a portion of the circular shaped body 150 (see FIG. 3). With reference to FIG. 3, the fastening aperture 158 may also include one or more threads that can be threadingly connected to the fastener 126.

Figure 7:
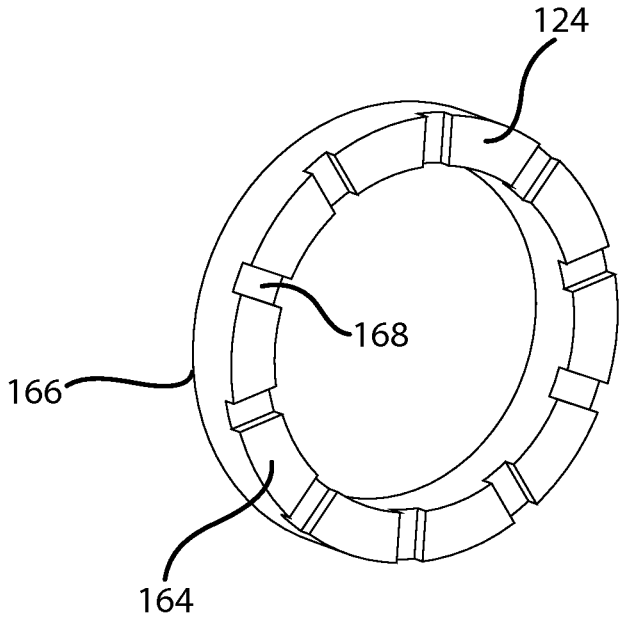
FIG. 7 is a rear isometric view of a dampener of the joint assembly of FIG. 1A.

FIG. 7 is a rear perspective view of the dampener 124 of the locking assembly 120. With reference to FIG. 7, the dampener 124 may be a ring-shaped member and include a first side 164 and a second side 166. The dampener 124 may be an elastomer, rubber, or other flexible material and is configured to impart a drag or otherwise increase the friction between various components of the locking assembly 120 and optionally may be used to dampen sounds and/or vibrations caused during movement of the joint assembly 100. The dampener 124 may also define a plurality of engagement grooves 168 radially cut or formed in the first side 164, whereas the second side of dampener 124 may be substantially flat.

Figure 8B:
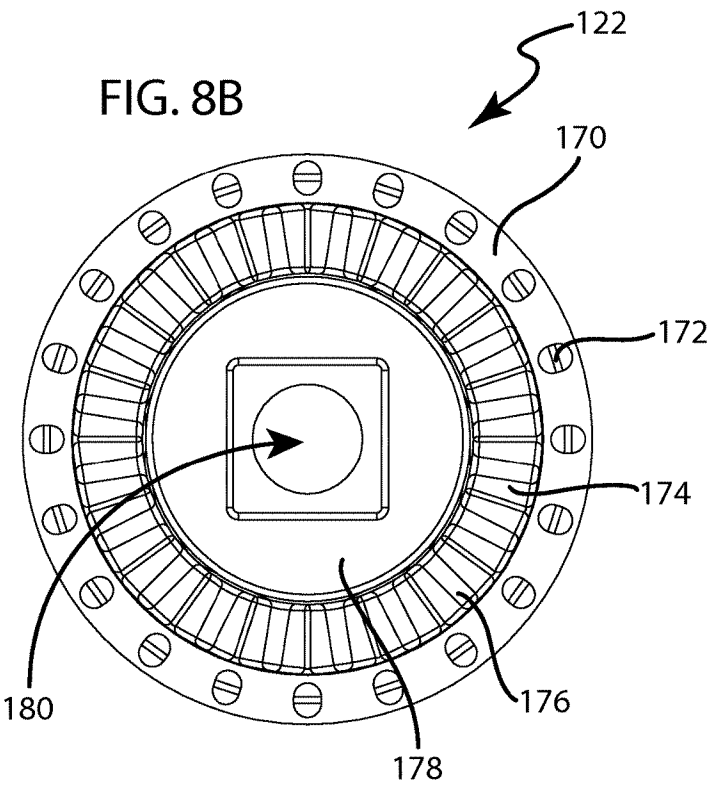
FIG. 8B is a rear elevation view of the clutch cap of FIG. 8A.
Figure 8A:
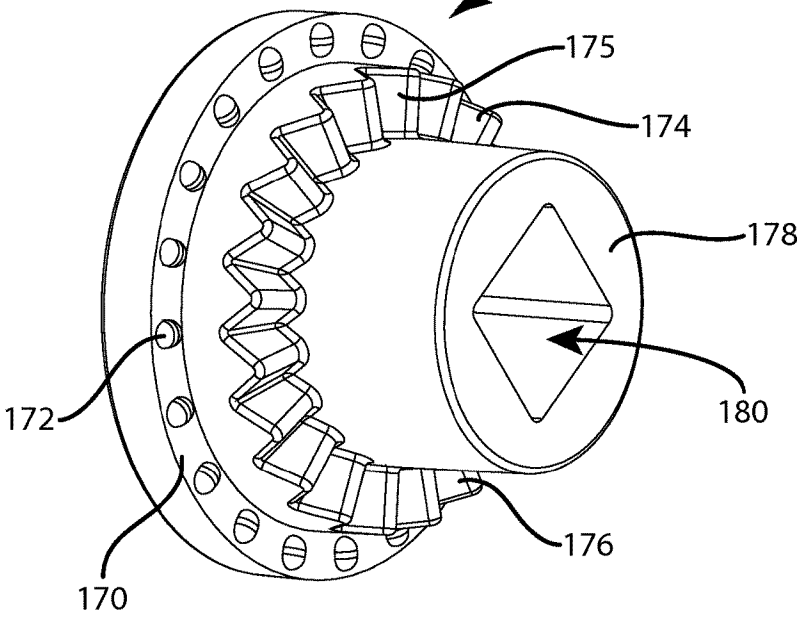
FIG. 8A is a rear isometric view of a clutch cap of the joint assembly of FIG. 1A.

FIGS. 8A and 8B illustrate various views of the clutch cap 122. With reference to FIGS. 8A and 8B, the clutch cap 122 may define a somewhat mushroom-shaped body that includes an outer end flange 170 and a securing flange 174 that form a cap to a shaft extension 178. The outer end flange 170 has a larger diameter than the other features of the clutch cap 122. The outer end flange 170 includes a substantially flat outer end surface (see FIGS. 1B and 2) and defines a shaft channel aperture 180 therethrough. The inner side of the outer end flange 170 may include a plurality of beads 172 defined along the peripheral edge of the outer end flange 170. The beads 172 may be equally spaced and extend around the entire outer edge of the outer end flange 170.

With reference to FIGS. 8A and 8B, a securing flange 174 may extend from the inner side of the outer end flange 170 around the shaft extension 178 and may be positioned within the ring of beads 172. The securing flange 174 has a smaller diameter than the outer end flange 170 and may also have a somewhat larger width and thickness than the outer end flange 170. The securing flange 174 may include an engagement feature 176 configured to mesh with the engagement feature on the clutch slider 128. For example, in one embodiment, the engagement feature 176 may be a plurality of crown gear teeth 175 extending outwards from and circumferentially around an end surface of the securing flange 174. In this embodiment, the gear teeth 175 may extend along a portion of a length of the clutch cap 122.

With continued reference to FIGS. 8A and 8B, the shaft extension 178 may extend outwards from the securing flange 174 and have a diameter that is smaller than both the securing flange 174 and the outer flange 170. The shaft extension 178 may be a generally cylindrically-shaped element positioned within the securing flange 174. The shaft extension 178 has a smaller diameter than both the outer end flange 170 and the securing flange 174. The shaft channel 180 extends through the shaft extension 178. The shaft channel 180 may define a square or rectangular shaped passage through the clutch cap 122 configured to receive the keyed end 150 of the pivot shaft 132. The shaft channel 180 may partially extend through the clutch cap 122 and terminate at a headwall 183. In the embodiment shown, e.g., in FIG. 3, the headwall 183 is located substantially in the same plane as the gear teeth 175 on the securing flange 174 but could be positioned elsewhere. The smaller diameter shaft channel aperture 181 extends through the outer end flange 170 and securing flange 174 and through the headwall 183 to connect with the shaft channel 180.

Assembly of the joint assembly 100 will now be discussed in further detail. With reference to FIGS. 2, 3, and 4C, the joint core 134 may be received into the cavity 107 defined by the second joint body 104 and a sealing member 137, such as an O-ring, may be received into the annular groove 135 on the joint core 134. The joint core 134 may be fixed within the second joint body 104 by, for example, corresponding keyed structures (not shown), adhesive, ultrasonic welding, or other fixation techniques, or a combination thereof. The pivot shaft 132 may then be received into the shaft aperture 133 of the joint core 134 with the securing features 162*a*, 162*b*, 162*b* on the secured end 160 being secured to corresponding securing features (not shown) in the joint core 134. The securing features 162*a*, 162*b*, 162*b* engage with the joint core 134 to secure the pivot shaft 132 in position and substantially prevent the pivot shaft 132 from rotating with respect to the joint core 134, even as the first joint body 102 rotates, as will be discussed in more detail below.

Once the pivot shaft 132 is secured to the core 134, the first joint body 102 may be connected to the pivot shaft 132 and to the second joint body 104. In some embodiments, a trim ring 106 may be positioned between the outer face of the second end 210 of the first joint body 102 and the outer face of the first end of the second joint body 104. The trim ring 106 may provide an aesthetically pleasing feature for the joint assembly 100 and may also assist in connecting the two joint bodies 102, 104 together. After the trim ring 106 has been positioned, the shaft duct 186 may be placed around the pivot shaft 132 with the body 150 being received within the shaft duct 186 and the keyed end 156 extending longitudinally outwards past a terminal end of the shaft duct 186 into the locking cavity 194. Optionally, one or more O-rings or other sealing members 153 may be positioned into the annular grooves 152, 154 of the pivot shaft 132 before the shaft 132 is received into the shaft duct 186.

With reference to FIGS. 3 and 4C, the biasing element 130 may be positioned within the spring cavity 206 and received around the shaft duct 186. In some embodiments, the biasing element 130 may be a coil spring and may extend slightly beyond the stop 204 defined in the locking bracket 190. However, in other embodiments, the biasing element 130 may be otherwise configured and may be substantially any other type of element capable of providing a biasing force. The biasing element 130 is typically selected so as to exert a sufficient biasing force to support the joint bodies and weight of components attached thereto to hold the position of the joint bodies relative to one another. In other words, the biasing element 130 exerts a biasing force sufficient to prevent rotation of the first joint body relative to the second joint body without a user rotational force exerted onto the first joint body, this includes a force sufficient to resist rotation due to the weight of a showerhead and any accessories (e.g., bracket for holding shampoo, soap, etc.) that may be connected to the second joint body directly or indirectly.

With reference to FIGS. 3, 4C, and 5, once the biasing element 130 is positioned within the first joint body 102, the clutch slider 128 is positioned within the locking cavity 194 of the first joint body 102. In particular, the clutch slider 128 may be partially positioned around the terminal end of the shaft duct 186 and the ribs 136 of the clutch slider 128 may be aligned with the corresponding grooves 198 defined by the slide track 208 of the first joint body 102. The alignment feature 140 on the outer surface 138 of the clutch slider 128 may be used to position the clutch slider 128 in a desired orientation within the locking cavity 194 and may align with a section of the slide track 208 that includes a corresponding alignment feature. The clutch slider 128 may be oriented within the locking cavity 194 such that the first end 142 including the engagement structure 146 is oriented towards the first end 184 of the first joint body 102. The clutch slider 128 may have a length that is shorter than the length of the slide track 208, which as will be discussed in more detail below, allows the clutch slider 128 to slide longitudinally within the first joint body 102. The engagement of the clutch slider 128 with the slide track 208 keys the clutch slider 128 to the track to prevent the clutch slider 128 from rotating within the first body 102 while allowing the clutch slider 128 to move longitudinally within the first body as will be discussed in more detail below.

With reference to FIGS. 3, 7, and 8A, once the clutch slider 128 is connected to the first joint body 102, the dampener 124 may be placed on the clutch cap 122. For example, the dampener 124 may be positioned around the outer surface of the securing flange 174 and the flat surface of the dampener 124 may be seated against the beads 172 on the inner side of the outer end flange 170. The beads 172 act to assist in frictionally engaging the dampener 124 with the clutch cap 122. The engagement grooves 168 of the dampener 124 may be oriented towards the shaft extension 178 of the clutch cap 122. In some embodiments, the dampener 124 may have a slightly larger diameter than the outer flange 170 and may extend outwards past an outer peripheral edge of the outer flange 170.

With reference again to FIG. 3, the clutch cap 122 and dampener 124, once connected to each other, may be connected to the first joint body 102. In particular, the shaft channel 180 may be positioned around the keyed end 156 of the pivot shaft 132. The securing flange 174 of the clutch cap 122 may be aligned with the engagement structure 146 of the clutch slider 128 so that the teeth 145 of the clutch slider 128 mesh with the teeth 175 of the clutch cap 122. Additionally, with reference to FIGS. 3, 4A and 7, the dampener 124 may be positioned so that the engagement ribs 200 of the slider track 208 are positioned within the engagement grooves 168 of the dampener 124. The top ends of the engagement ribs 200 may seat within the engagement grooves 168 and the first side 164 of the dampener 124 with the engagement grooves 168 seats against the seat 202. The outer edge of the dampener 124 may be compressed against the interior walls of the locking bracket 190 and first body 102.

With reference to FIGS. 1B and 3, once the clutch cap 122 is in position, the fastener 126 may be received into the shaft channel aperture 181 defined through the outer end flange 170 and be threaded into the fastening aperture 158 of the pivot shaft 132. The fastener 126 acts to secure the clutch cap 122 to the pivot shaft 132, which, due to the anchoring or the secured end 160 of the pivot shaft 132 within the joint core 134, prevents the clutch cap 122 from rotating with the first arm portion 102, i.e., allows the clutch cap 122 to rotate relative to the first arm portion 102. The first surface of the outer flange 170 may also act as a cover for the locking cavity 194 of the second arm portion.

Figure 9B:
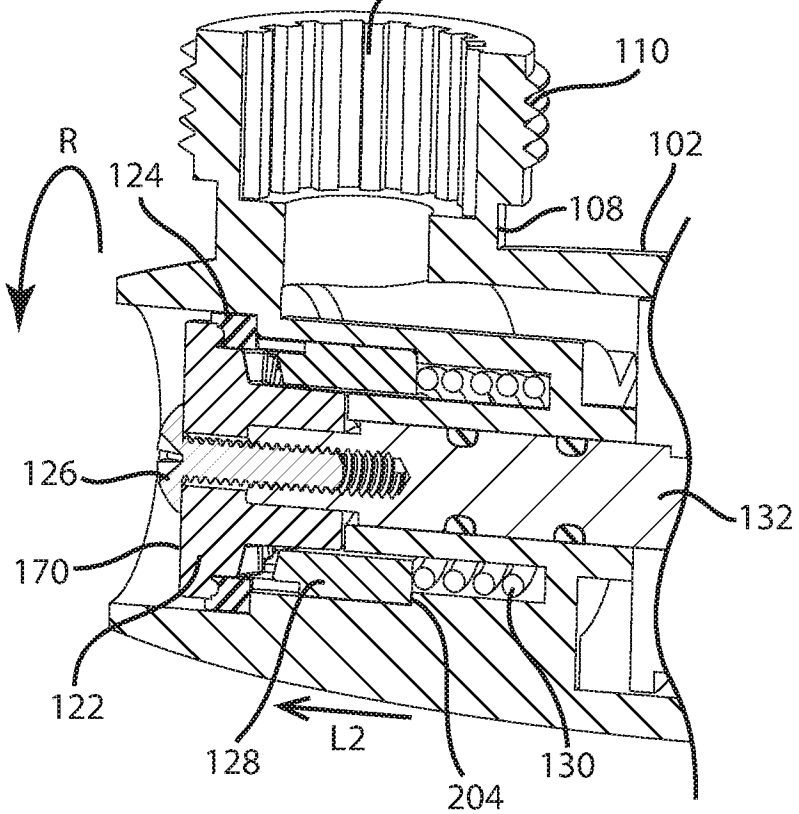
FIG. 9B is a cross-section view similar to FIG. 3 illustrating the joint assembly in an unlocked position.
Figure 9A:
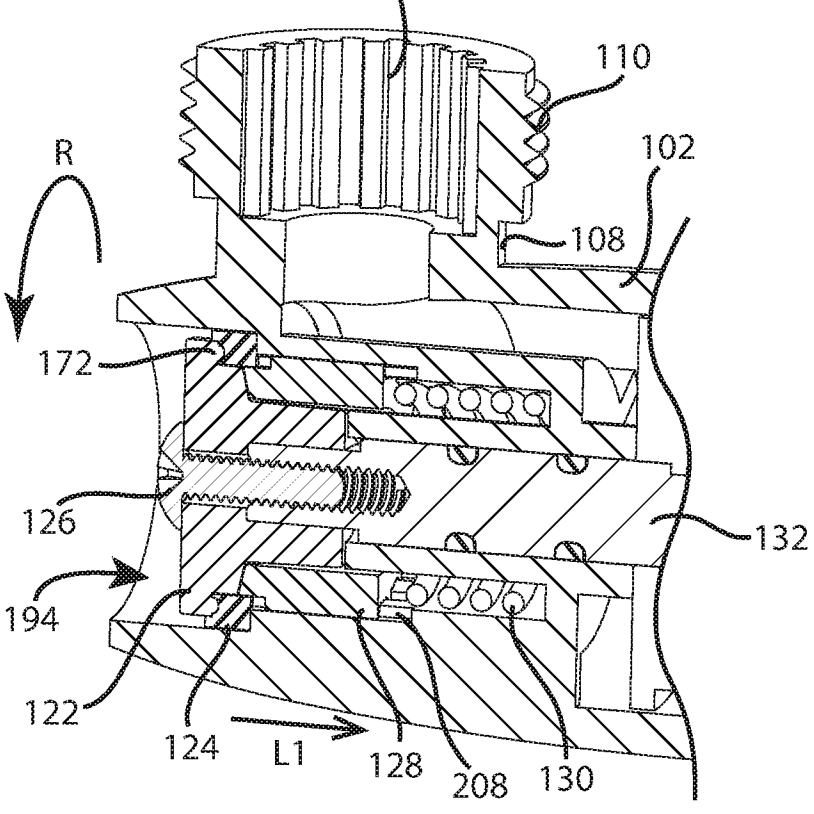
FIG. 9A is a cross-section view similar to FIG. 3 illustrating the joint assembly in a locked position.
Figure 10A:
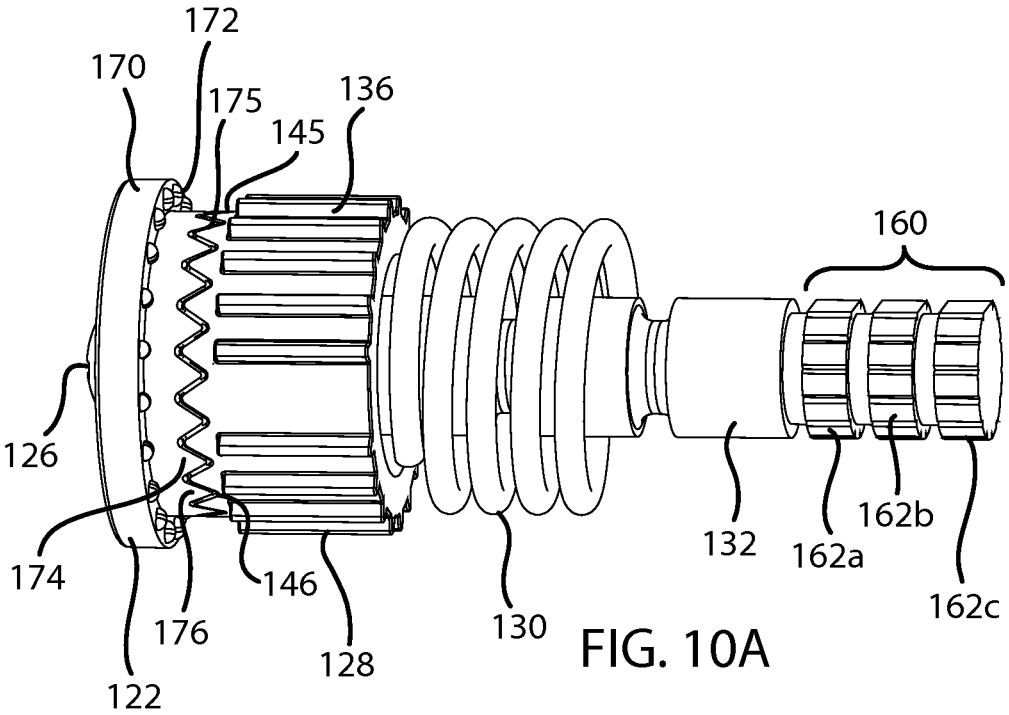
FIG. 10A is an isometric view of a locking assembly of the joint assembly in the locked position shown in FIG. 9A.
Figure 10B:
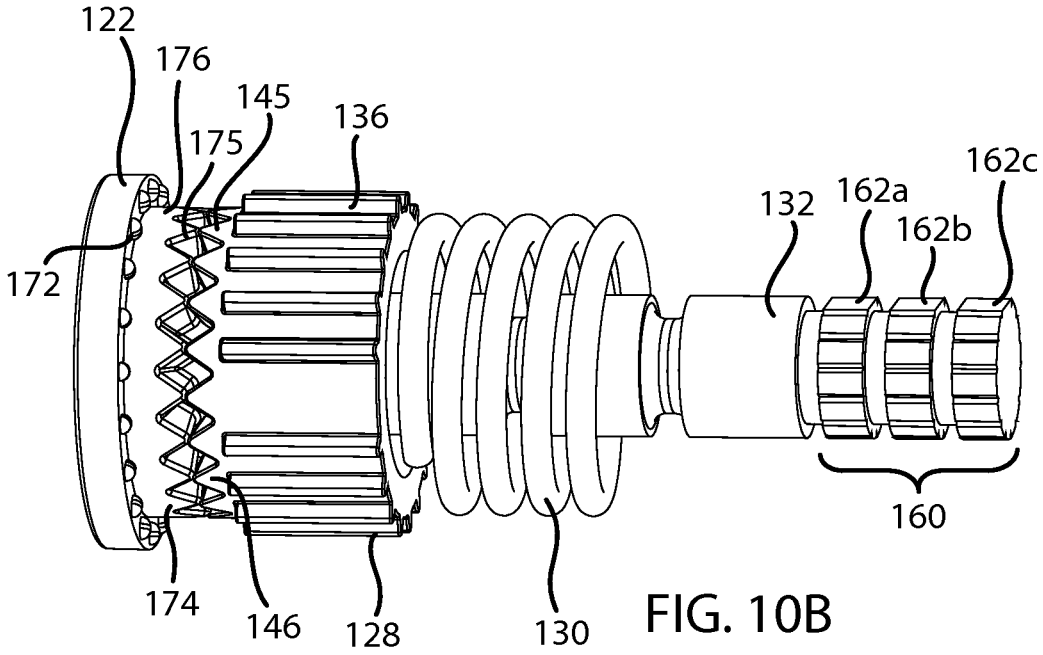
FIG. 10B is an isometric view of the locking assembly of the joint assembly in the unlocked position shown in FIG. 9B.

Operation of the automatically locking arm joint 100 will now be discussed in more detail. FIG. 9A illustrates a cross-section view of the arm joint 100 in a locked position. FIG. 9B illustrates a cross-section view of the arm joint 100 in an unlocked position. FIG. 10A is a perspective view of the locking assembly 120 in the locked position of FIG. 9A. FIG. 10B is a perspective view of the locking assembly 120 in the unlocked position of FIG. 9B. With reference to FIGS. 9A and 10A, in the locked position of the locking assembly 120, the teeth 145 of the engagement structure 146 on the clutch slider 128 mesh with the teeth 175 of the securing flange 174 of the clutch cap 122. The meshing of the teeth 145, 174 prevents the first and second joint bodies 102, 104 from moving relative to one another and secures the shower arm, showerhead, bracket, or other feature in a desired position.

To rotate the first joint body 102 relative to the second joint body 104, the user exerts a rotational force R on the first joint body 102 sufficient to overcome the biasing force exerted by the biasing member 130, i.e., exceeding the biasing threshold of the biasing member 130. As the first joint body 102 rotates due to the rotational force R, the clutch slider 128 rotates therewith due to the engagement of the ribs 136 within the grooves 198 of the slide track 208. When the clutch slider 128 rotates, the teeth 145 of the clutch slider 128 slip relative to the teeth 175 of the clutch cap 122. The clutch cap 122, which is anchored to the pivot shaft 132 by the fastener 126, does not rotate and so the slippage causes the teeth 175 of the clutch cap 122 to exert a force on the teeth 145 of the clutch slider 128. The clutch slider 128 is then forced to move longitudinally on the slide track 208 in the locking bracket 190 and moves in a first direction L1 towards the back end of the locking bracket 190.

With reference to FIGS. 9B and 10B, as the clutch slider 128 continues to move in the first direction L1, the teeth 145, 175 fully disengage and the clutch slider 128 compresses the biasing member 130. When the teeth 145, 175 are fully disengaged, the locking assembly 120 is in the disengaged position shown in FIG. 10B. The continued rotational force R causes the clutch slider 128 to further rotate relative to the stationary clutch cap 122, causing the teeth 145, 175 to align. The biasing member 130 then biases the clutch slider 128 longitudinally in the second direction L2 opposite the first direction L1 (towards the clutch cap 122). This causes the teeth 145, 175 to mesh again, but with the clutch slider 128 being located at a different angular alignment relative to the clutch cap 122.

During the rotation of the first joint body 102, the dampener 124 introduces a drag and resists the rotational force R by virtue of its engagement with the interior wall of the first body 102 and connection to the engagement ribs 200. The dampener 124 increases the friction between the rotating clutch slider 128 and first joint body 102 and the stationary clutch cap 122. This slows down the rotation of the joint assembly 100, to allow a user to more easily choose a desired location without "overshooting" or having to readjust the position a number of times before a desired position is reached. Additionally, the dampener 124 may dampen the vibrations and noise that may be created during activation of the locking assembly 120.

In the above example, the first joint body 102 is movable relative to the second joint body 104, which remains stationary or fixed relative to the motion of the first joint body 102. However, in other embodiments, the first joint body 102 may remain fixed relative to the second joint body 104. For example, a user may apply the rotational force R to the second joint body 104, which will cause the joint core 134 and pivot shaft 132 (anchored thereto) to rotate with the second joint body 104. As the pivot shaft 132 rotates, the fastener 126 and the clutch cap 122 will rotate with the pivot shaft 132. However, the clutch slider 128, which is fixed due to the connection of the ribs 136 with the grooves 198 of the slide track 208 of the first joint body 102, will not rotate. As the rotational force R is applied, the rotation of the clutch cap 122 causes the teeth 175 to slip relative to the teeth 145 of the clutch slider 128 and forces the clutch slider 128 to move longitudinally in the first direction L1, disengaging the clutch cap 122 and the clutch slider 128.

Once the teeth 145, 175 are disengaged, the locking assembly 120 is in the unlocked position and the second joint body 104 can be rotated relative to the first joint body 102. Once the teeth 145, 175 realign, the biasing member 130 exerts a biasing force to cause the clutch cap 128 to move longitudinally in the second direction L2 and to engage or mesh with the teeth of the clutch cap 122 again, locking the arm joint 100.

As described above, the arm joint assembly 100 may be used to reposition the first joint body 102 relative to the second joint body 104 or vice versa. In each embodiment, one of the joint bodies 102, 104 remains relatively fixed or stationary while the locking assembly 120 allows the other of the joint bodies 102, 104 to rotate. Because the locking assembly 120 automatically engages into a locked position as the user rotates one of the joint bodies 102, 104, the position of the moving joint body relative to the fixed joint body can be selected by a user without having to activate a separate button, lever, or the like. Additionally, the user can simply grasp a respective one of the joint bodies 102, 104 and rotate the body 102, 104 to change its position without having to first unlock or activate the motion of the arm joint 100 by pressing a button, rotating a nut, or the like.

Figure 11:
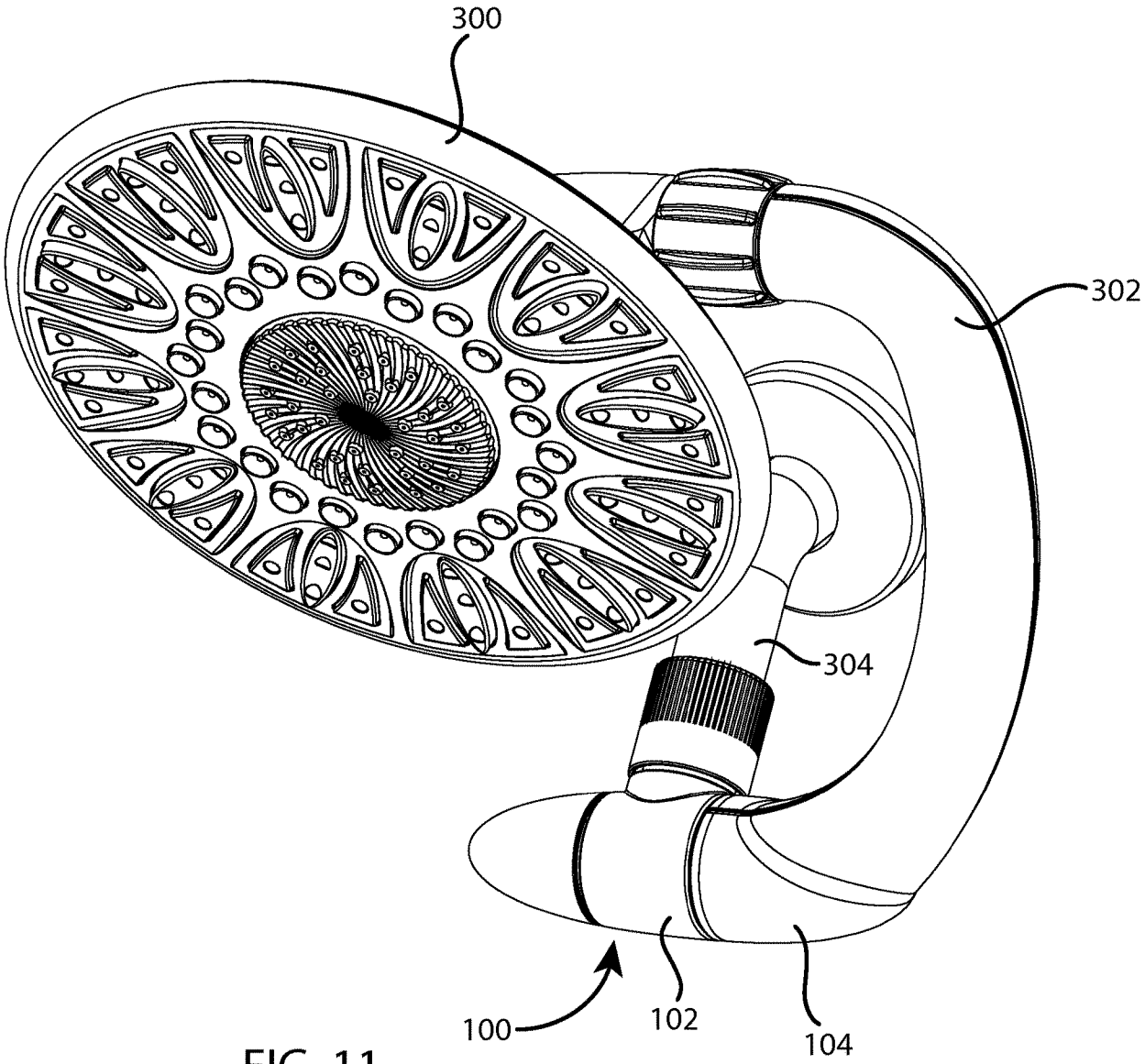
FIG. 11 is an isometric view of the joint assembly of FIG. 1A connected to a showerhead and a water supply pipe.

FIG. 11 illustrates a perspective view of a showerhead 300 including a shower arm 302 attached to the joint assembly 100. With reference to FIG. 11, a user can reposition the showerhead 300 by moving one of the first joint body 102 or the second joint body 104 relative to the other. The automatically locking assembly 120 automatically locks into a desired position as the user rotates the selected body 102, 104. In this embodiment, the first joint body 102 is connected to a J-pipe 304 that is anchored to a wall or other support structure and thus would remain stationary while the second joint body 104, integrated into the end of the shower arm 302, rotates with respect thereto. It should be noted that the example shown in FIG. 11 is exemplary only and many other showerhead structures, or other fluid connectors, may be connected to and/or used with the joint of the present disclosure.

Conclusion

It should be noted that any of the features in the various examples and embodiments provided herein may be interchangeable and/or replaceable with any other example or embodiment. As such, the discussion of any component or element with respect to a particular example or embodiment is meant as illustrative only.

It should be noted that although the various examples discussed herein have been discussed with respect to showerheads, the devices and techniques may be applied in a variety of applications, such as, but not limited to, sink faucets, kitchen and bath accessories, lavages for debridement of wounds, car washes, lawn sprinklers, and/or toys.

All directional references (e.g., upper, lower, upward, downward, left, right, leftward, rightward, top, bottom, above, below, vertical, horizontal, clockwise, and counterclockwise) are only used for identification purposes to aid the reader's understanding of the examples of the invention, and do not create limitations, particularly as to the position, orientation, or use of the invention unless specifically set forth in the claims. Joinder references (e.g., attached, coupled, connected, joined and the like) are to be construed broadly and may include intermediate members between the connection of elements and relative movement between elements. As such, joinder references do not necessarily infer that two elements are directly connected and in fixed relation to each other.

In some instances, components are described by reference to "ends" having a particular characteristic and/or being connected with another part. However, those skilled in the art will recognize that the present invention is not limited to components which terminate immediately beyond their point of connection with other parts. Thus the term "end" should be broadly interpreted, in a manner that includes areas adjacent rearward, forward of or otherwise near the terminus of a particular element, link, component, part, member or the like. In methodologies directly or indirectly set forth herein, various steps and operations are described in one possible order of operation but those skilled in the art will recognize the steps and operation may be rearranged, replaced or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A coupling for fluid pathways comprising:

a fixed member;

a movable member rotatably coupled to the fixed member; and a locking assembly connected to the fixed member and received within the movable member, the locking assembly including:

a slider movably connected to the movable member; and a clutch cap fixedly connected to the fixed member, wherein the cap engages the slider to secure a position of the movable member relative to the fixed member; wherein in response to a rotational force on the movable member, the cap disengages from the slider and the slider rotates within the movable member and moves longitudinally in a first longitudinal direction within the movable member to unlock the movable member from the fixed member, allowing the movable member to rotate relative to the fixed member;

upon cessation of the rotational force on the movable member, the slider moves longitudinally in a second longitudinal direction to lock the movable member relative to the fixed member, preventing the movable member from rotating; and during the rotation of the movable member, a distance between the fixed member and the movable member remains constant.

2. The coupling of claim 1, wherein the locking assembly further comprises a biasing member engaging the slider, wherein the biasing member biases the slider in the second longitudinal direction and to move the slider in the first longitudinal direction and unlock the movable member, the rotational force overcomes a biasing force of the biasing member.

3. The coupling of claim 1, wherein the cap and the slider each comprise gears that selectively mesh and slide relative to one another.

4. The coupling of claim 1, wherein the locking assembly further comprises a dampener that exerts a force against the rotational force to resist movement of the movable member.

5. The coupling of claim 1, wherein the fixed member is configured to be connected to a J-pipe and the movable member is configured to be connected to a showerhead.

6. The coupling of claim 1, wherein the slider is housed and moves within the movable member.

7. An automatically locking joint for a shower arm comprising a first joint body;

a second joint body movably connected to the first body and defining a locking cavity, wherein the second joint body is spaced at a fixed distance from the first joint body; and a locking assembly at least partially received within the locking cavity comprising a clutch slider connected to the second body and configured to rotate therewith and move longitudinally along a portion of a length of the locking cavity;

a clutch cap positioned adjacent to the clutch slider and fixedly connected to the first body; and a stationary pivot shaft, wherein the pivot shaft fixedly connects the clutch cap to the first joint body; wherein rotation of the second body relative to the first body causes the clutch slider to selectively engage and disengage from the clutch cap.

8. The automatically locking joint of claim 7, further comprising a dampener connected to the first joint body and the clutch cap, wherein the dampener resists the rotation of the second joint body.

9. The automatically locking joint of claim 7, wherein the clutch slider comprises at least one slider engagement feature; and the clutch cap comprises at least one cap engagement feature; wherein engagement of the at least one slider engagement feature with the at least one cap engagement feature secures a position of the second joint body relative to the first joint body.

10. The automatically locking joint of claim 9, wherein the at least one slider engagement feature and the at least one cap engagement feature are gears.

11. The automatically locking joint of claim 9, wherein rotation of the second joint body causes the clutch slider to move longitudinally in a first direction along the portion of the length of the locking cavity.

12. The automatically locking joint of claim 11, further comprising a biasing member positioned in the locking cavity and engaging a first end of the clutch slider, wherein the biasing member biases the clutch slider in a second direction.

13. The automatically locking joint of claim 9, wherein the locking cavity further comprises a track, wherein in response to a rotational force, the clutch slider slides along the track in a first direction and in response to a biasing force the clutch slider slides along the track in a second direction.

14. The automatically locking joint of claim 13, wherein the track comprises a plurality of ribs for engaging the clutch slider.

15. The automatically locking joint of claim 14, wherein at least a portion of the ribs are longer than the remaining ribs.

16. The automatically locking joint for a shower arm of claim 7, wherein the clutch slider and the clutch cap are positioned completely within the locking cavity defined by the second joint body and movement of the clutch slider is within the second joint body.

17. An automatically locking coupling comprising a first member;

a second member; and a locking assembly connected to the second member and selectively permitting rotation of the second member relative to the first member, the locking assembly comprising a sliding member coupled to the second member and rotatable therewith and movable longitudinally relative to the second member;

a cap anchored to the first member; and a pivot shaft fixedly connected to the first member and the cap; wherein the sliding member engages the cap to retain the second member in a fixed position relative to the first member; and application of a rotational force to the second member disengages the sliding member from the cap, allowing rotation of the second member relative to the first member.

18. The automatically locking coupling of claim 17, wherein the locking assembly further comprises a biasing member coupled to the sliding member, wherein the biasing member exerts a biasing force against the sliding member to cause the sliding member to engage the cap; and when the rotational force exceeds the biasing force, the sliding member disengages from the cap.

19. The automatically locking coupling of claim 18, wherein the biasing member is received around a first portion of the pivot shaft and the sliding member is received around a second portion of the pivot shaft and slides longitudinally relative to the pivot shaft.

* * * * *